United States Patent [19]

Dorsey et al.

[11] 4,326,769

[45] Apr. 27, 1982

[54] ROTARY COAXIAL ASSEMBLY

[75] Inventors: Glenn F. Dorsey; James C. Hassall, II, both of Blacksburg, Va.

[73] Assignee: Litton Systems, Inc., Blacksburg, Va.

[21] Appl. No.: 142,246

[22] Filed: Apr. 21, 1980

[51] Int. Cl.[3] ..... H01R 11/22; H01R 17/06

[52] U.S. Cl. ..... 339/177 E; 339/8 P; 339/256 RT

[58] Field of Search ..... 339/177 R, 177 E, 8 PB, 339/8 P, 9 RY, 256 RT

[56] References Cited

U.S. PATENT DOCUMENTS 2,641,744 6/1953 De Packh et al. ..... 339/8 PB
3,617,990 11/1971 Colardeau ..... 339/177 E

FOREIGN PATENT DOCUMENTS 2035681 1/1972 Fed. Rep. of Germany ..... 339/256 RT

*Primary Examiner*—Eugene F. Desmond
*Attorney, Agent, or Firm*—Brian L. Ribando

[57] ABSTRACT

A rotary coaxial assembly comprises an external and an internal socket which is lined with a conductive louvered band and which mates with an external and an internal pin. The fit between the sockets and the pins are such that a first coaxial cable which is attached to the external and internal sockets may rotate as a unit with respect to a second coaxial cable which is attached to the external and the internal pins.

1 Claim, 2 Drawing Figures

ROTARY COAXIAL ASSEMBLY

BACKGROUND OF THE INVENTION

The invention relates to a rotary coaxial joint used for connecting two coaxial cables end-to-end.

Coaxial cables used for conducting high frequency signals between two points are well known in the prior art. It is often necessary that one portion of the coaxial cable be able to rotate relative to another portion necessitating the use of a rotary slip ring joint. The impedance of such a rotary joint should closely match the impedance of the coaxial cable in order to maintain insertion losses at a minimum, and the physical structure of the rotary joint should comprise a coaxial type of construction which is similar to the construction of the cable. Known prior art rotary joints tend to be bulky in their construction and are not truly coaxial.

SUMMARY AND OBJECTS OF THE INVENTION

A rotary coaxial assembly comprises an external and internal pin which mates with an external and an internal socket. The first coaxial cable is coupled to the pin assembly and a second coaxial cable is coupled to the socket assembly. A louvered conductive band which is secured within the external and internal sockets provides conductivity between the sockets and the pins in a structure which is only slightly larger in diameter than the coaxial cable and the multiplicity of contacts in the conductive bands produces a low noise rotary joint.

It is therefore an object of this invention to provide a rotary coaxial assembly.

It is a further object of the invention to provide a rotary coaxial assembly comprising internal and external pins and sockets which are allowed to rotate freely relative to one another.

It is a further object of the invention to provide a rotary coaxial assembly in which louvered conductive bands provide low noise electrical contact between external pins and sockets and internal pins and sockets such that the pins are able to rotate freely as a unit with respect to the sockets.

These and other objects of the invention will become apparent from the following detailed description taken in conjunction with the accompanying drawing figures is which like reference numerals designate like or corresponding parts throughout the figures.

DESCRIPTION OF THE PREFERRED EMBODIMENT

Figure 1:
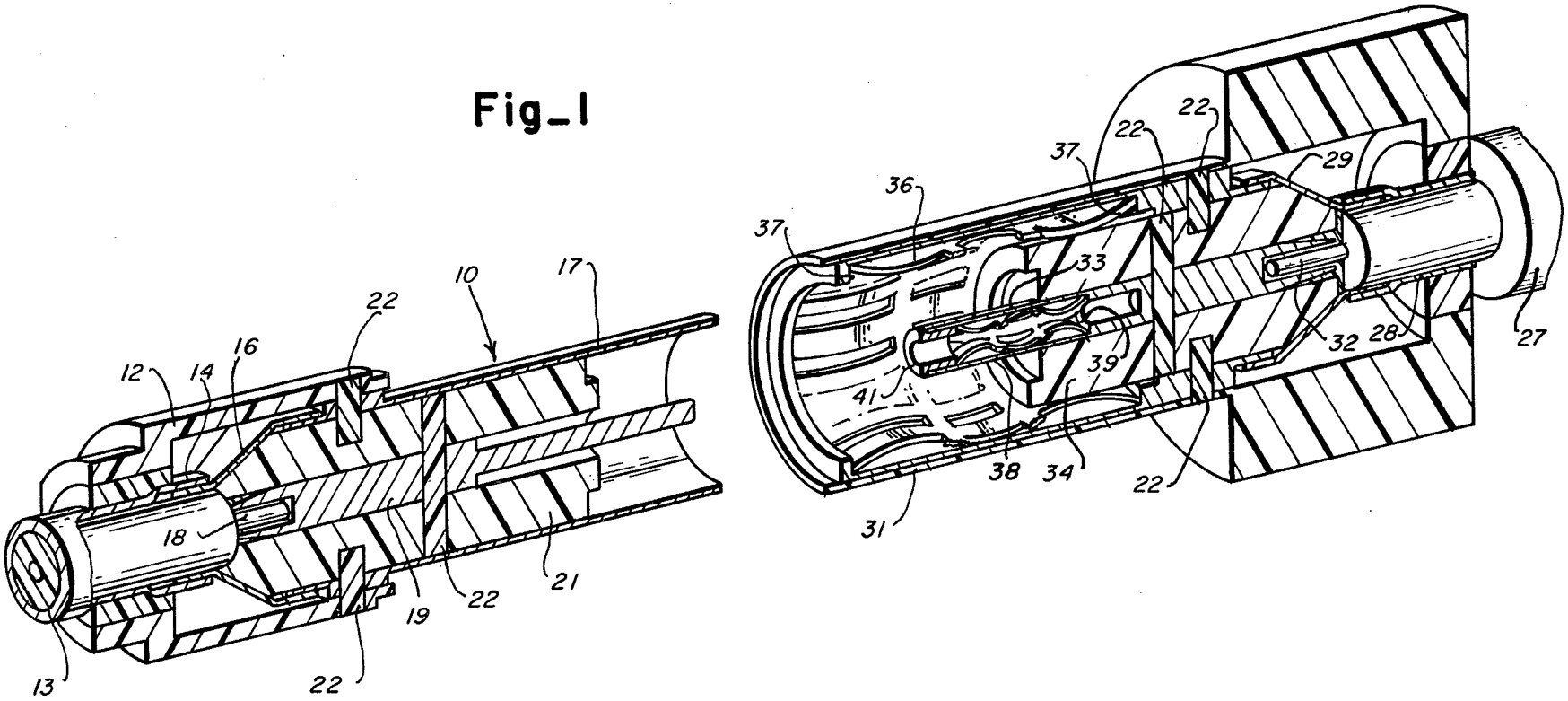
FIG. 1 is an exploded sectional view in perspective showing a rotary coaxial assembly according to the invention.
Figure 2:
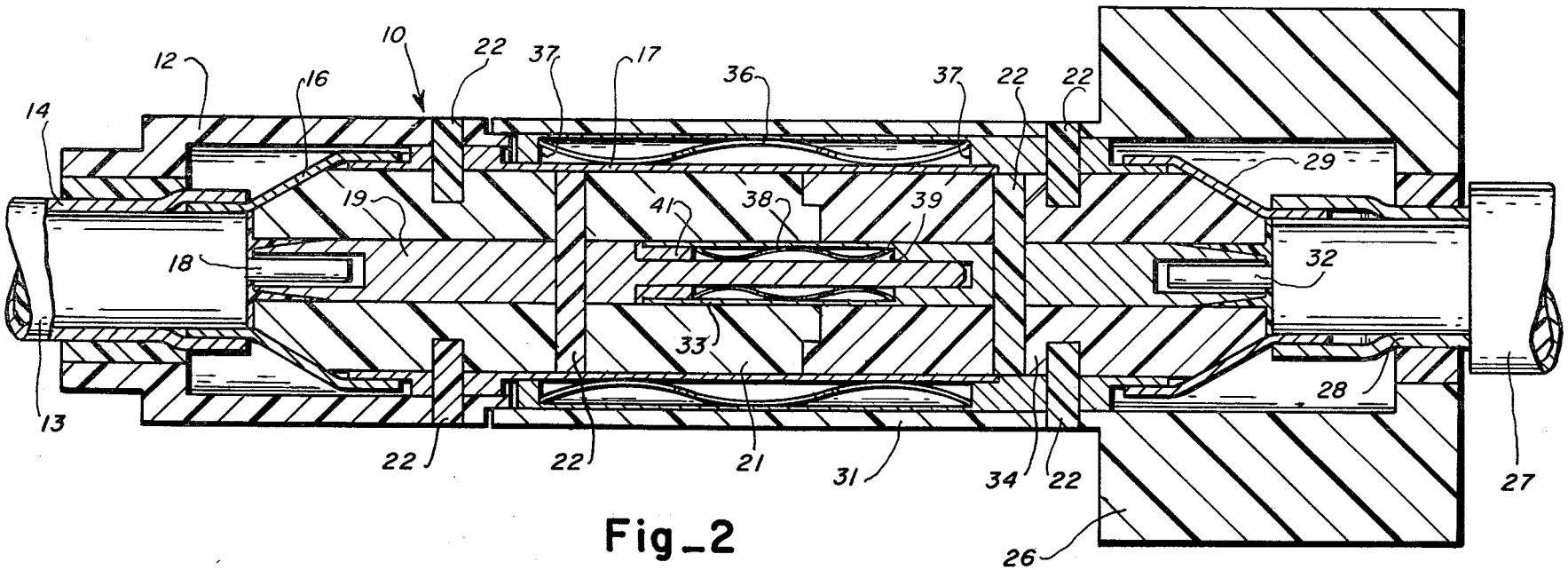
FIG. 2 is a side sectional view showing the coaxial assembly of FIG. 1.

Referring now to the drawings, there is shown in FIG. 1 a miniature coaxial assembly generally designated by the reference numeral 10. The assembly 10 comprises a stator cover 12 which receives a first coaxial cable 13. The outer shield 14 of the coaxial cable 13 is electrically coupled as by soldering to a tapered adaptor 16.

The adaptor 16 is electrically coupled to a hollow external pin 17, and is tapered to allow a physical transition therebetween. An internal lead 18 of the coaxial cable 13 is coupled by soldering to an internal pin 19. A stator insulator 21 electrically isolates the hollow external pin 17 from the internal pin 19 and allows a characteristic impedance closely matching that of the cable 13 to be achieved. A plurality of stator retaining pins 22 retain the assembly in a unitary relationship.

The rotary assembly further comprises a rotary housing 26 which receives a second coaxial cable 27. The outer shield 28 of the second coaxial cable is coupled to a tapered rotor adaptor 29 which is coupled to an external socket 31. The internal lead 32 of the second coaxial cable is coupled to an internal socket 33 which is maintained centered within the external socket 31 by a rotor insulator 34. A compliant conductive louvered band 36 is maintained within the external socket 31 by shoulders 37 which are formed on the ends of the external socket. Such a louvered band is commercially available under the tradename MULTILAM from the Multilam Corporation in Los Altos, California. A second louvered band 38 is positioned within the internal socket 33 and maintained in place by the shoulder 39 formed on the rear of the internal socket and a retaining ring 41 positioned in the front of the socket. Those regions of the external and internal sockets in which the louvered bands 36 and 38 are positioned may be filled with a lubricant in order to reduce the friction between the bands and the external and internal pins of the stator when the rotary joint is in an assembled condition.

The fit between the louvered bands 36 and 38 and the external and internal pins 17 and 19 is such that relative rotational motion is allowed therebetween and the multiple contacts presented by the bands 36 and 38 to the pins 17 and 19 create a rotary joint which is exceptionally noise free. In order to maintain the stator and the rotor assembly in a mating relationship with one another, an external bracket, not shown, may be provided to prevent the stator assembly from withdrawing from the rotor assembly.

Having thus described the invention, various modifications and alterations will occur to those skilled in the art, which modifications and alterations are intended to be within the scope of the appended claims.

What is claimed is:

1. In a miniature rotary coaxial assembly for electrically coupling two coaxial leads one to the other, a combination comprising:

a stator cover and a rotary housing, an external pin and a smaller diameter internal pin rigidly fixed to the stator cover, stator insulation means for electrically insulating the external pin from the internal pin and for maintaining a coaxial relationship therebetween, stator adaptor means for electrically coupling the external lead of a first coaxial cable to the external pin and means for electrically coupling the internal lead of said first coaxial cable of the internal pin, an external socket and a smaller internal socket rigidly fixed to the rotary housing, rotor insulation means for electrically insulating the external socket from the internal socket and for maintaining a coaxial relationship therebetween, rotor adaptor means for electrically coupling the external lead of a second coaxial cable to the external socket and means for electrically coupling the internal lead of said second coaxial cable to the internal socket, a first conductive band of elongated louvered contacts lining the external socket and electrically coupling said external socket to the external lead, a second conductive band of elongated louvered contacts lining the internal socket and electrically coupling said internal socket to the internal pin, wherein the fit between the first conductive band and the external pin and between the second conductive band and the internal pin allows relative rotational motion therebetween and provides a low noise sliding electrical contact, whereby the rotary housing in the second coaxial cable and the external and internal sockets rotate freely as a unit with respect to the stator cover, the first coaxial cable, and the external and internal pins.

* * * * *